US005779184A

United States Patent [19]

Kaufmann et al.

[11] Patent Number: 5,779,184

[45] Date of Patent: Jul. 14, 1998

[54] DEVICE AND METHOD FOR STABILIZING A PAPER WEB AT A TIME BEFORE THE WEB IS CUT

[75] Inventors: Bernd Kaufmann, Heidenheim; Herbert Illenberger, Nattheim, both of Germany

[73] Assignee: Voith Sulzer Papiermaschinen GmbH, Heidenheim, Germany

[21] Appl. No.: 939,987

[22] Filed: Sep. 29, 1997

Related U.S. Application Data

[63] Continuation of Ser. No. 614,740, Mar. 13, 1996, abandoned.

[30] Foreign Application Priority Data

Mar. 17, 1995 [DE] Germany ..... 295 04 553.1

[51] Int. Cl.[6] ..... B65H 19/20; B65H 21/00; B65H 69/06; B65H 69/02

[52] U.S. Cl. ..... 242/554.2; 242/555.3; 242/556.1; 226/195

[58] Field of Search ..... 242/615.11, 554.2, 242/555.3, 553.4, 553.6, 556.1; 226/195; 83/175, 81

[56] References Cited

U.S. PATENT DOCUMENTS

| | | | |
|---|---|---|---|
| 2,710,153 | 1/1955 | Baumrucker, Jr. et al. | 242/420.3 |
| 3,132,544 | 5/1964 | Jones | 226/95 X |
| 3,396,887 | 8/1968 | Bade | 226/195 X |
| 3,408,144 | 10/1968 | Cowan | 226/95 X |
| 3,738,587 | 6/1973 | Cristiani | 242/554.2 |
| 3,780,960 | 12/1973 | Tokuno et al. | 242/556.1 X |
| 3,807,056 | 4/1974 | Norfolk | 242/615.11 X |
| 4,002,047 | 1/1977 | MacPhee et al. . | |
| 4,448,629 | 5/1984 | Malthouse et al. | 83/175 X |
| 4,880,178 | 11/1989 | Goulette | 242/556.1 X |
| 4,909,890 | 3/1990 | Bonnyman | 226/195 X |
| 4,936,942 | 6/1990 | Sollinger et al. . | |
| 5,388,387 | 2/1995 | McElvy | 242/555.4 X |
| 5,411,223 | 5/1995 | Gatteschi | 242/554.2 X |
| 5,443,681 | 8/1995 | Stivani et al. | 242/556.1 X |
| 5,474,252 | 12/1995 | Schmid | 242/554.2 |

FOREIGN PATENT DOCUMENTS

| | | | |
|---|---|---|---|
| 853255 | 3/1951 | Germany | 226/95 |
| 2507560 | 8/1975 | Germany | 226/95 |
| 38 15 277 A1 | 1/1989 | Germany . | |
| 6082563 | 10/1985 | Japan | 226/95 |

OTHER PUBLICATIONS

English abstract of Japanese patent document No. 05132914, Nov. 22, 1994.

Voith Publication, p. 2827.

*Primary Examiner*—Michael Mansen
*Assistant Examiner*—Gregory J. Strimbu
*Attorney, Agent, or Firm*—Taylor & Associates, P.C.

[57] ABSTRACT

A device is provided for stabilizing a paper web in an unwinding and splicing station. The splicing station includes a primary paper roll and a secondary paper roll. A suction trough extends across a width of the paper web and includes a suction zone adjacent the paper web. The paper web unwinds from the secondary paper roll and passes the suction trough. The suction zone extends substantially across the width of the paper web and is configured to effect a substantially uniform vacuum in its area, wherein the unwinding paper web runs evenly over the suction zone area.

23 Claims, 7 Drawing Sheets

DEVICE AND METHOD FOR STABILIZING A PAPER WEB AT A TIME BEFORE THE WEB IS CUT

This is a continuation of application Ser. No. 08/614,740, filed Mar. 13, 1996 now abandoned.

BACKGROUND OF THE INVENTION

1. Field of the Invention

The present invention relates to a device for stabilizing a paper web.

2. Description of the Related Art

Suction boxes are used, e.g., for web stabilization in unwinding stations of a coater. The paper webs are made endless in these unwinding stations, thus enabling a continuous processing operation. This action consists of splicing the one paper roll, before it is fully depleted, to the next full roll. The web remainder of the nearly depleted secondary paper roll is cut off by means of a serrated blade, and the new web leader of the large paper roll is passed through the coater instead. Taking place on the fly, this procedure is mostly called "flying splice" in the paper industry; refer to the Voith publication entitled "Splice View-Electronic Components for Visualization, " publication No. p. 2827. The aim in such unwinding stations is to perform the cut-off operation as safely as possible. Among others, it is necessary to safeguard keeping the paper web maximally plane. This is important in order for the serrated cut-off blade to penetrate the paper web simultaneously across its entire width and, thus, also sever it evenly. But with corrugations present in the paper web that extend in the direction of web travel, the "higher areas" of the paper web are severed only after the lower areas. The result is a curvilinear progression superimposed on the serrated cutting line. Such irregular cutting lines can result in uncontrolled web breaks and, thus, interruptions of the operation.

According to DE-OS 38 15 277, a web stabilizer is arranged behind the cut-off blade. This arrangement has the disadvantage of leaving a relatively long web remainder after the cut-off operation (at least the web length from the cutting point to the point of contact between splicing roll and new paper roll). As the paper web continues passing through the coater, a hazardous flapping of the web remainder occurs frequently on the web guide rolls, which may lead to a break of the entire paper web and, thus, standstill of the paper machine.

SUMMARY OF THE INVENTION

The present invention provides a maximally clean and safe cut-off operation, where the waviness created in the paper web is extensively eliminated.

The action of the inventional suction zone—in the presence of vacuum—is such that the paper web is sucked down uniformly across its entire width, thereby smoothing any waves that are present and extend in the direction of web travel. This makes a clean cut-off from the secondary paper roll possible.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
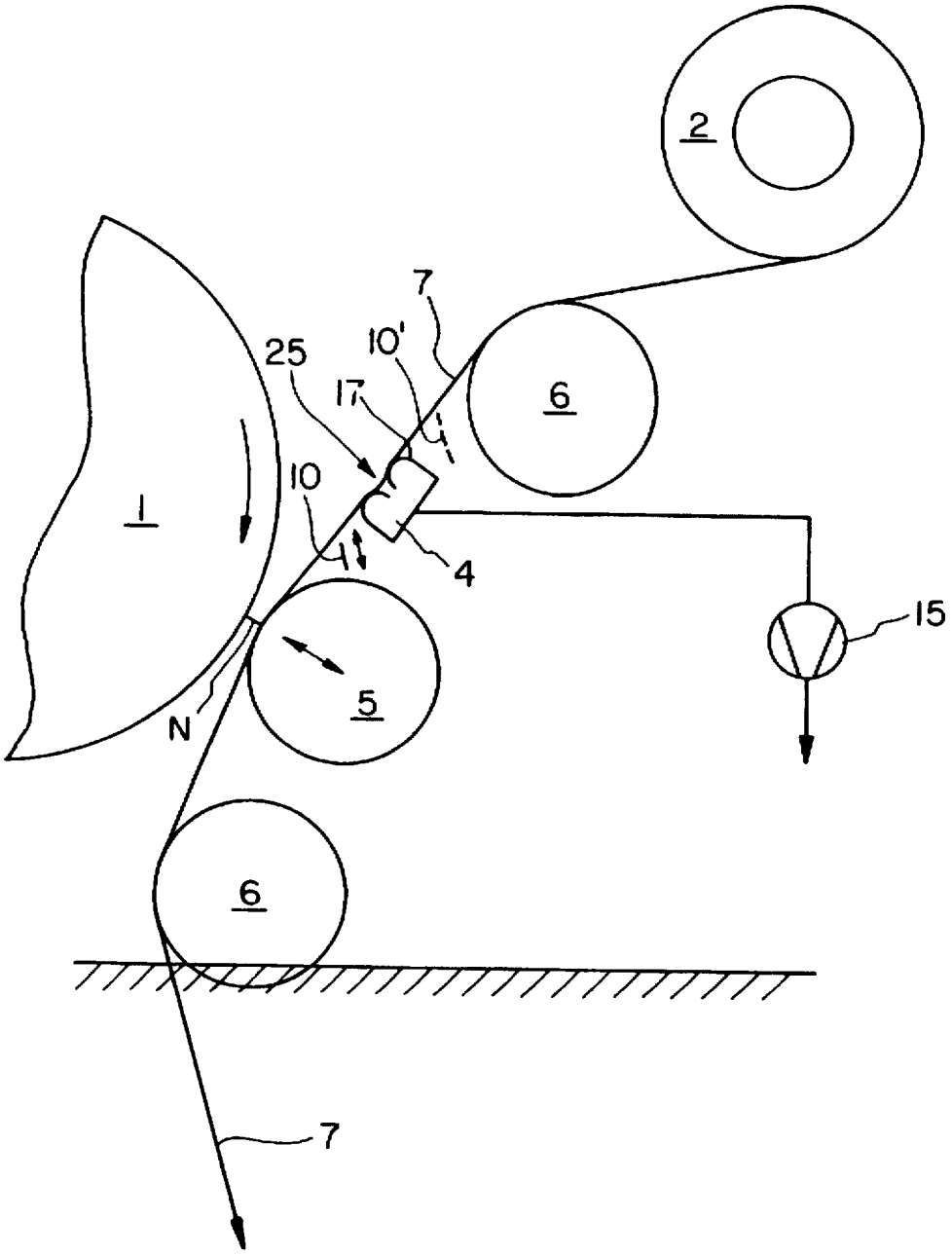
FIG. 1 is a schematic illustration of an unwinding and splicing station including an embodiment of a suction box of the present invention.
Figure 2:
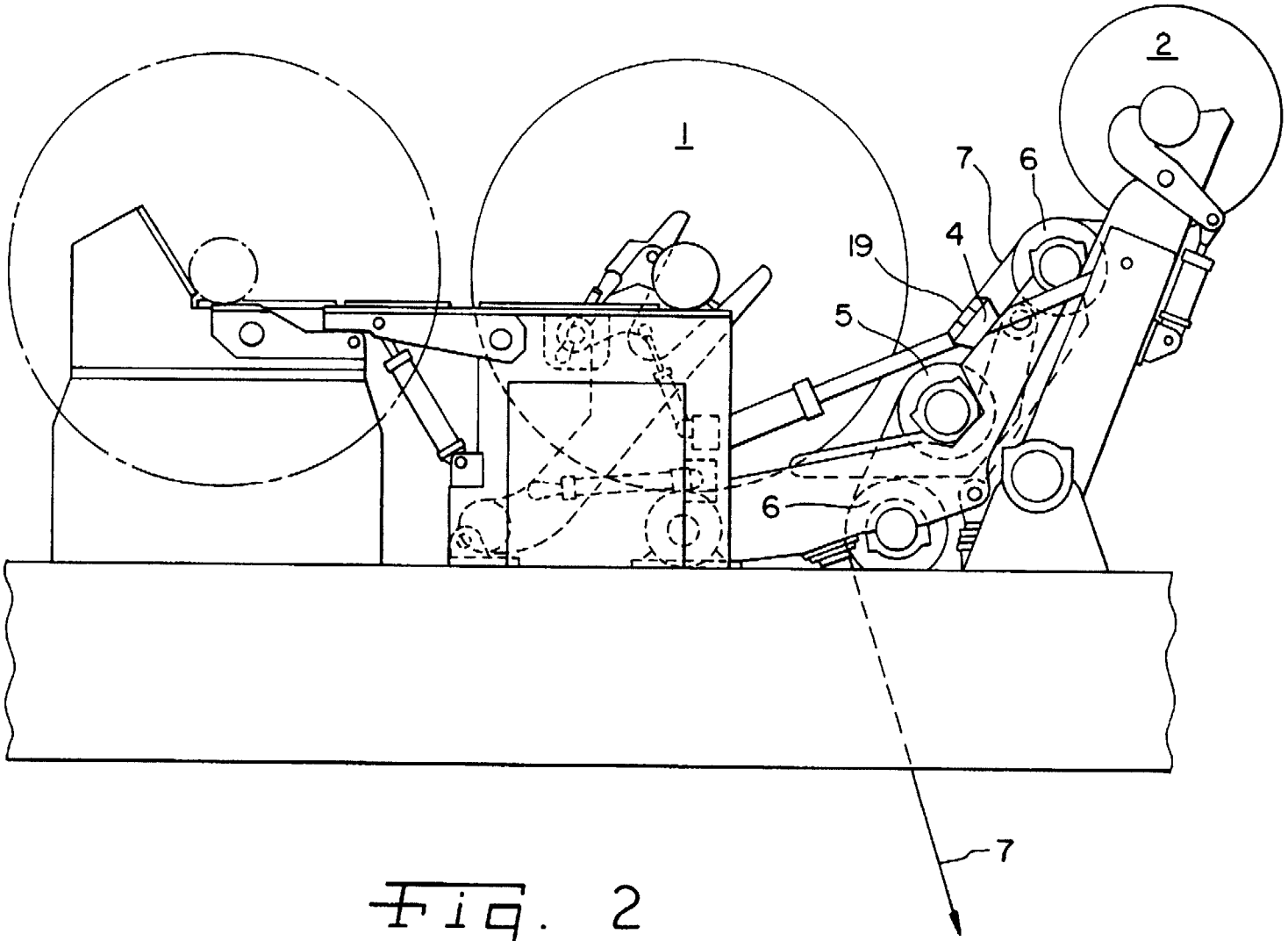
FIG. 2 illustrates an embodiment of a suction box of the present invention in an unwinding and splicing station of a coater analogous to FIG. 1, but with an additional, primary paper roll kept in reserve.

FIG. 1 illustrates an embodiment of the structure of the inventional device and the splicing of the paper web 7. The same basic structure is also depicted in FIG. 2.

The web leader of the new paper roll on the so-called primary roll 1 is attached to the paper roll itself using a specific, not illustrated adhesive tape. At the same time, however, splicing points are skipped, which are then attached, later in the splicing operation, on the still unwinding paper web 7. Owing to the shape of the approach rounding 17 of suction box 4 and the boundary air layer created with paper webs traveling at high speed, the paper web passes across the suction box 4 without touching it, so that a suction box can be installed even above the common tangential plane of splicing roll 5 and paper guide roll 6.

To preclude damage to the paper web at the exit edge of the suction box, a defined rounding is provided there—the exit rounding 18 (FIGS. 5–7 and 9). Shortly before depletion of the secondary paper roll 2 (i.e., of the unwinding paper web), the primary roll 1 is accelerated rotationally until the peripheral speed of the primary paper roll 1 matches the speed of web travel.

Figure 5:
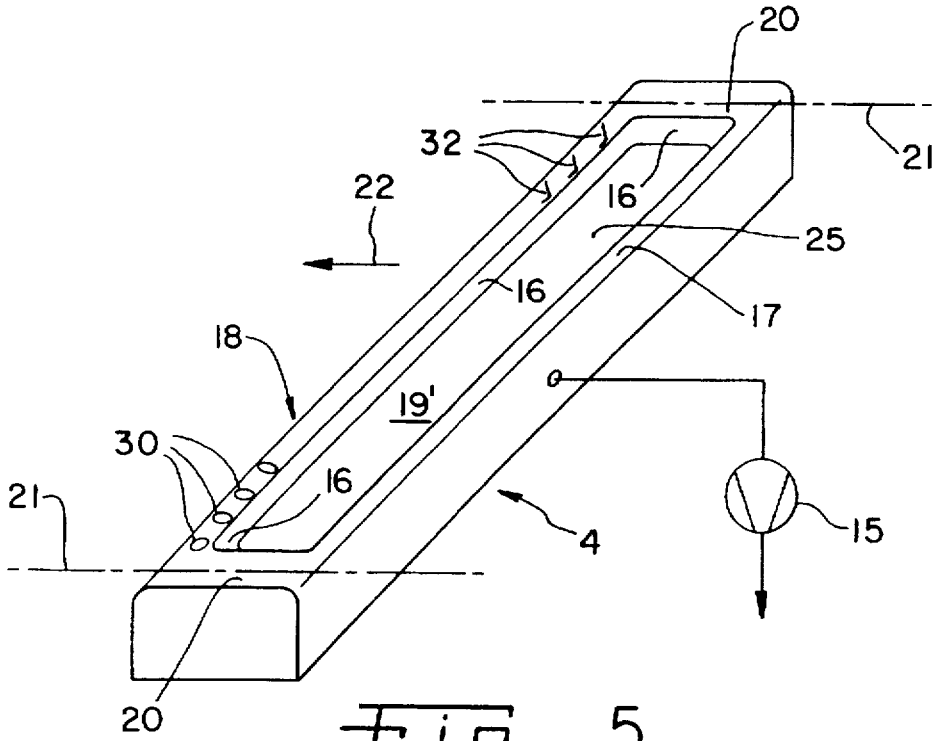
FIGS. 5 and 6 are perspective views of alternate embodiments of a suction box according to the present invention.
Figure 6:
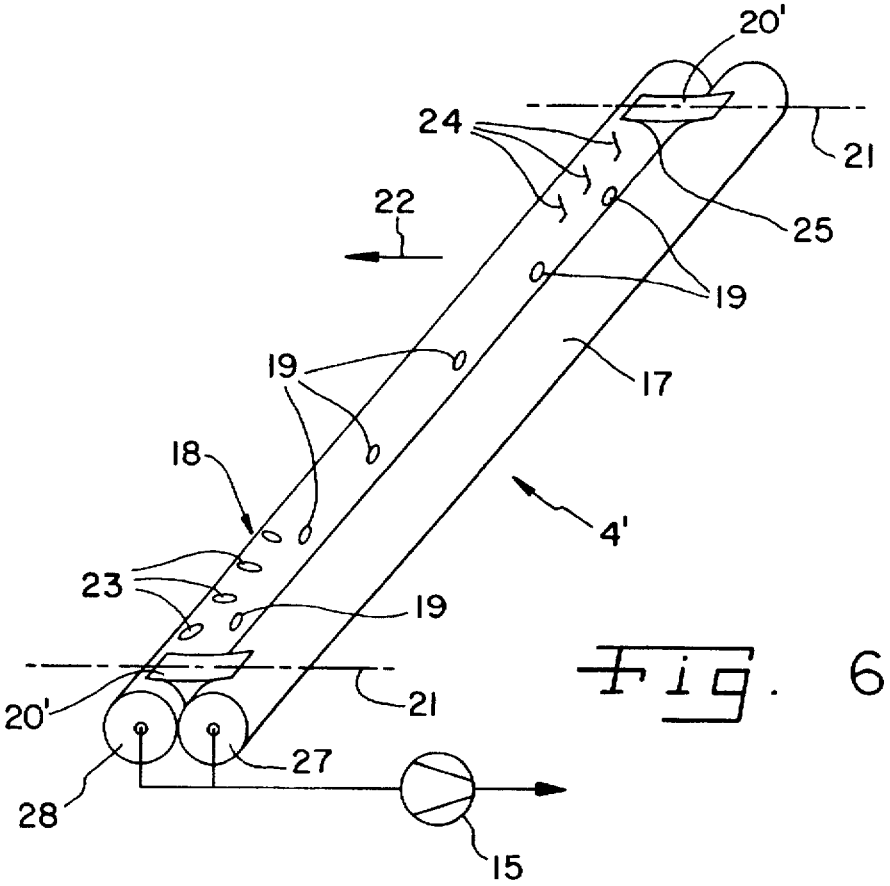

Just a few seconds before the splicing operation, a defined vacuum is allowed to act on the suction box 4, causing the paper web 7 to no longer glide across the suction box, but to be pulled in the recess (suction zone 25) illustrated in FIGS. 1, 5 and 6. This results in a good smoothing effect on the web (i.e., corrugations extending previously in the longitudinal direction of the web are being smoothed out) between the splicing roll 5 and the preceding paper guide roll 6. Since the paper web 7 is being smoothed also before and after the suction box, the cut-off device or cut-off blades 10, 10' (FIG. 1) can be arranged both between the suction box 4 and splicing roll 5 or between suction box 4 and the preceding paper guide roll 6. The first position (cut-off blade 10) has the advantage of producing a considerably shorter web remainder.

A mark on the periphery of the primary paper roll 1 allows the control electronics array to recognize where the prepared splicing point is located on the periphery of the primary paper roll 1. As a splicing operation is now initiated (manually or also automatically), the splicing roll 5 is in timed dependence on the revolution of the splicing point forced abruptly on a primary paper roll 1 while the cut-off blade 10 strikes the paper web 7. The already unwound web of the secondary paper roll 2 is then in known fashion kept away from the splicing location or nib N (FIG. 1) by means of (here not illustrated) blowing devices.

Figure 3:
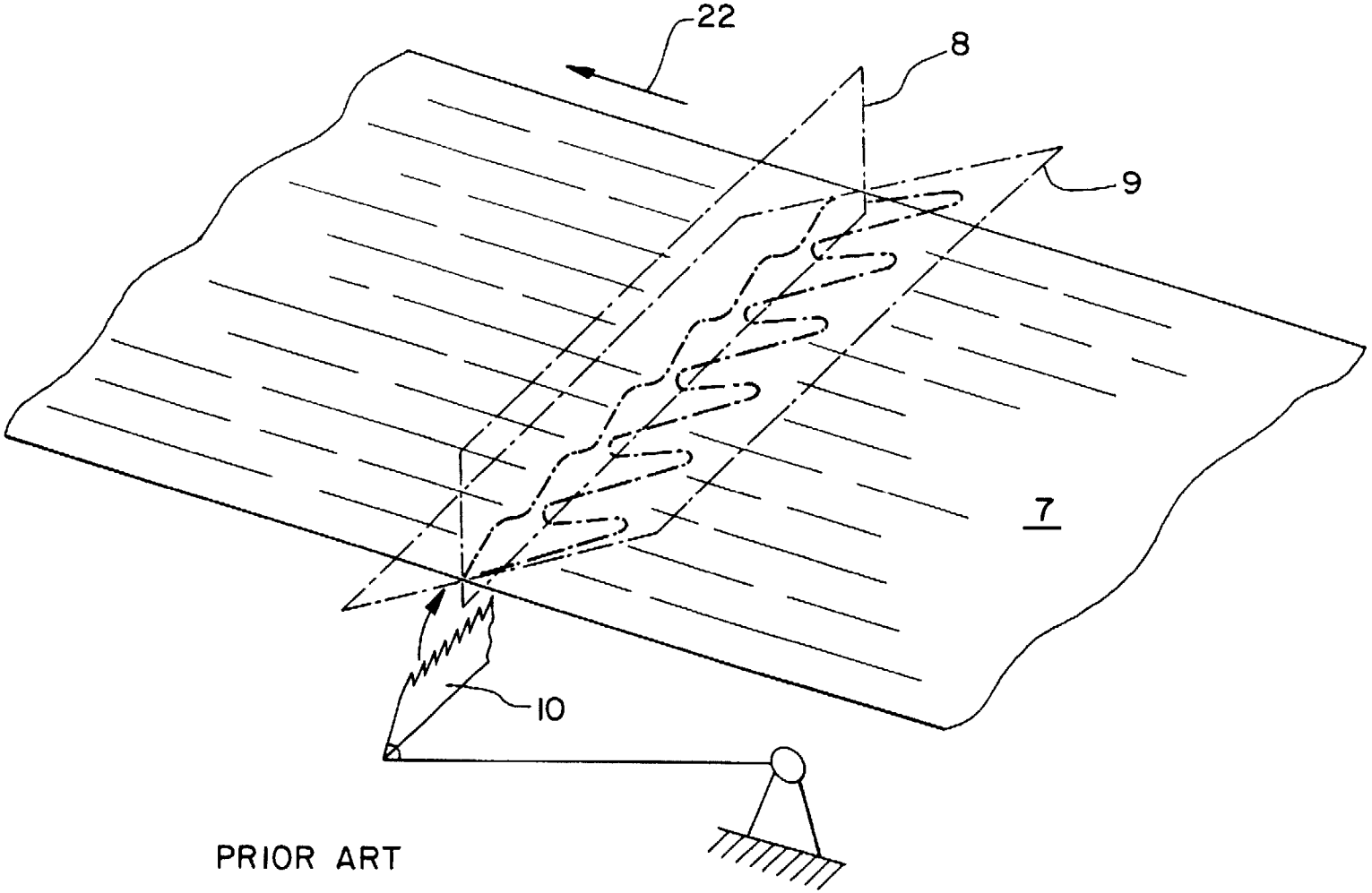
PRIOR ART Fig. 3
FIG. 3 is a basic illustration of corrugations formed in a prior art paper web.

FIG. 3 serves to illustrate the amplification effect of the web waviness in the imaginary perpendicular plane 8 relative to the direction of web travel 22, by the interaction of the web travel and the motion of the cut-off blade 10 according to the prior art.

The amplified corrugation is illustrated by dash-dot line in the resulting sectional plane 9, in which the cut-off blade 10 engages obliquely the paper web 7.

Figure 4:
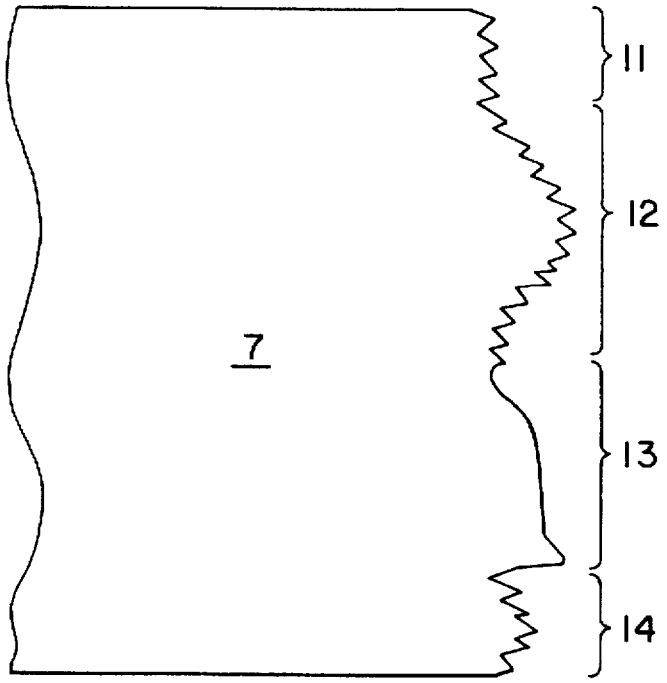
PRIOR ART Fig. 4
FIG. 4 is an exemplary defective paper web cut-off.

FIG. 4 depicts various web cut-off defects occurring without suction box. Section 11 represents a correct cut, with only the serration effect showing on the paper web, due to the serrated cut-off blade. In section 12, a paper waviness superimposes on the serration line. Section 13, in contrast, could have produced a cut-off line resembling that of section 12. Due to the web having been partially severed already, however, an uncontrolled tear continued at this point in the paper web. In section 14, the waviness of the paper web is evident again. Nonetheless, the waviness was considerably reduced at this point, so that the serrated shape is not so much superimposed by a curvilinear shape.

Figure 11:
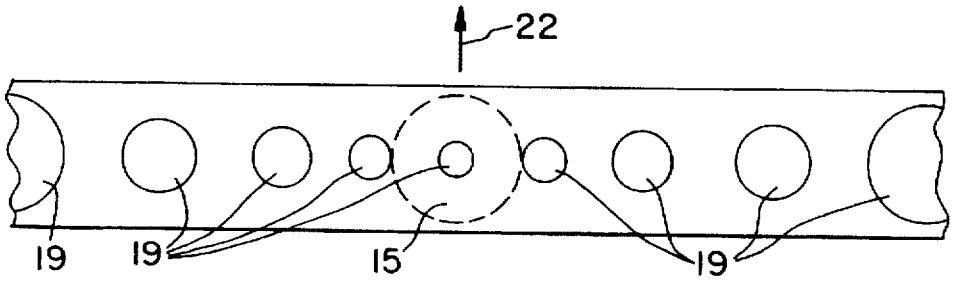
FIGS. 11, 12 and 13 are plan views of alternate embodiments of the inventional suction zone of the suction box.
Figure 12:
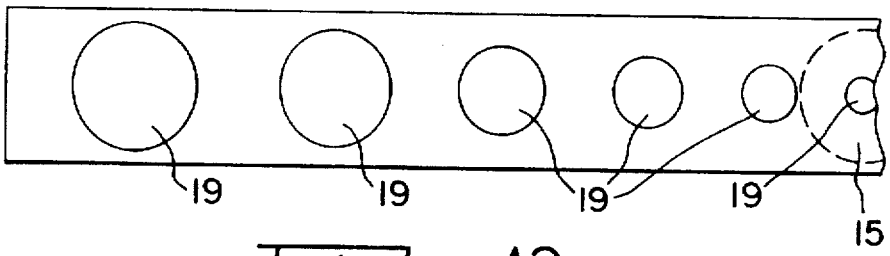
Figure 13:
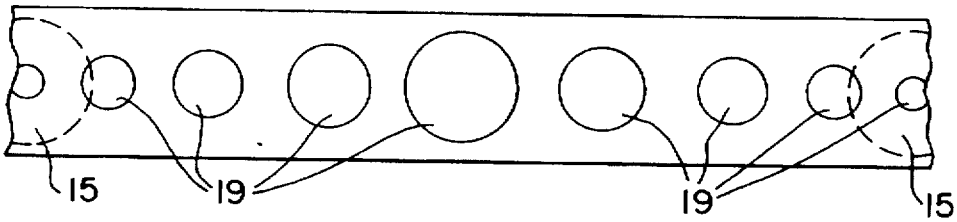

Suction box 4 illustrated in FIG. 5 is a sheet metal structure attached to a suction system 15. Instead of numerous suction perforations 19 facing the paper web, as shown in FIG. 11 through 13, only a single suction perforation 19 may be provided as well, as shown in FIG. 5. Moreover, the suction box contains rounded rims 16 in the suction zone, approach rounding 17 and exit rounding 18, and endwise suction zone bounds 20.

Suction trough or box 4' depicted in FIG. 6 is of a simple design, but fashioned from pipe stock. The area between facing pipes 27 and 28 must be nearly airtight—possible with the use of a connecting part. Pipes 27 and 28 are disposed side-by-side and connected to each other. The suction perforations 19 are provided either in at least one pipe 27 or 28. The suction system 15 may be arranged on the pipe ends or arbitrarily on the pipe shell. The suction zone 25 is endwise bounded by suction zone bounds 20'. Due to the shape to be sealed at the pipe ends, suction zone bounds 20' are wedged-shaped here.

Figure 7:
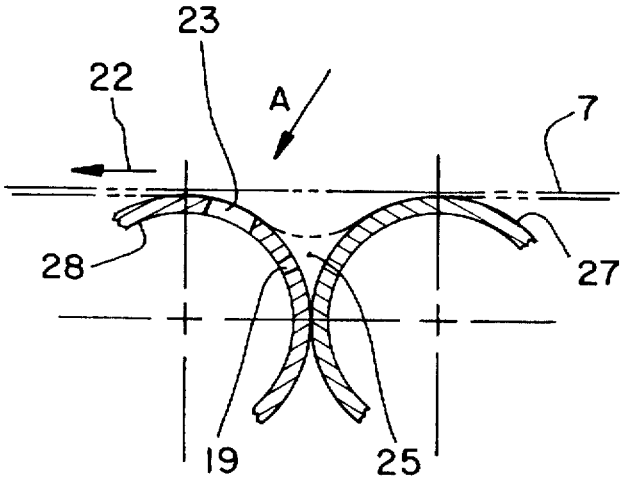
FIGS. 7, 8, 9 and 10 illustrate embodiments of so-called spreaders on the suction box.

FIG. 7 is a section through a suction box 4' made of pipes, such as illustrated in FIG. 6.

Figure 8:
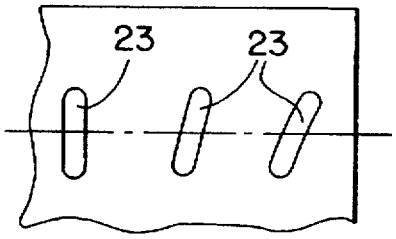

FIG. 8 shows the pertaining view A in FIG. 7. The course of the paper web is shown in an unsuctioned state (straight dash-dot line) and suctioned state (concave dash-dot line).

Figure 9:
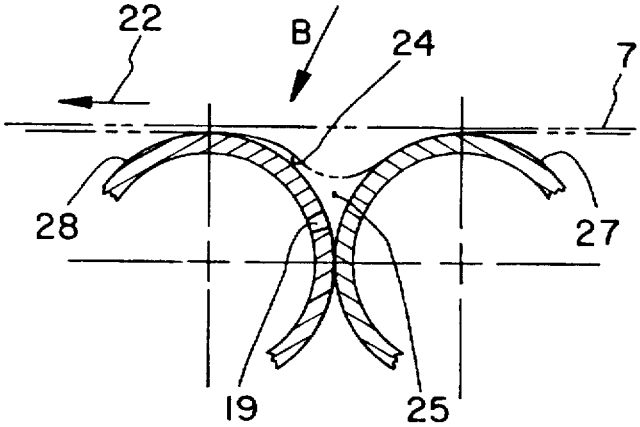

The web is partly pulled into the suction zone 25, creating a wave which extends crosswise to the direction of travel 22 of web 7 (this is the concave line) whereby—as mentioned before—waves (longitudinal waves depicted in FIG. 3) extending in the longitudinal direction 22 are being smoothed, thereby accomplishing a clean cut-off of web 7 from the secondary paper roll 2. So-called spreaders are provided on the suction box 4 or 4' to enhance the smoothing effect. The spreaders may be either spreader slots 23 (FIGS. 7 and 8) or spreader cams 24 (FIGS. 9 and 10).

The spreader slots 23 and spreader cams 24 are arranged preferably on each end section of the suction box 4 or 4'. Viewed in the direction of web travel 22, the spreaders slant toward the nearest paper web edge 21. This slant increases from spreader to spreader, deviating up to about 30° from the direction of web travel.

Figure 10:
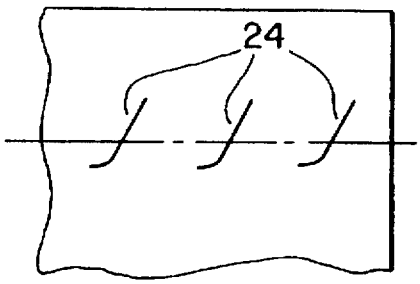

In addition to FIGS. 8 and 10, spreader slots 30 and spreader cams 32 are also shown in FIG. 5.

Provided in addition to spreader slots 23, the suction perforations 19 are required for a good wrap of the rounded suction zone rims 16.

FIGS. 9 and 10 illustrate an option analogous to FIG. 7 and 8. Instead of a suction slot, however, an oblong spreader cam 24 is used here as spreader. Owing to the tight wrap around spreader cams 24, their edges exert a good spreading effect.

A so-called spreading effect with the spreader slots 23 and spreader cams 24 results in that the paper web 7 slides over the spreader slots 23 and spreader cams 24 as described before. This aids additionally in smoothing the web.

Figure 14:
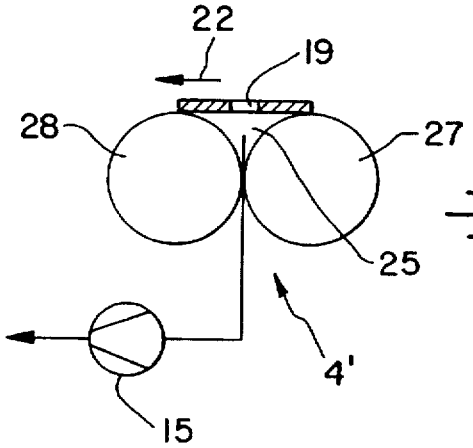
FIG. 14 is the inventional suction box according to FIG. 6 with a modified suction zone.

FIG. 14 shows another variant of the suction zone 25. While FIGS. 6 through 10 show a suction zone 25 that is open toward paper web 7, suction zone 25 in FIG. 14 is bounded by a plate 30, which prevents the web from being pulled into the "recess." A plurality of suction perforations 19 are fashioned in the plate 30. The suction perforations 19 are arranged preferably in parallel succession, such as illustrated in FIGS. 11 through 13. In order to produce upon connection of the suction system 15 a uniform vacuum across the entire web width and thus pass the web free of waves and flat across the suction zone 25, the areas of suction perforations 19 increase gradually in size. The starting point of the gradual area enlargement of perforations 19 in the longitudinal direction of plate 30 is the application site of suction system 15. This means that the suction effect is the greatest where suction system 15 is effective. Suction perforations 19 may in this area be smaller than those arranged in an area farther removed from suction system 15. Instead of the illustrated and described plate 30, a screen type structure is also possible.

Plate 30 may include suction perforations 19 instead of the sole, oblong suction perforation 19' illustrated in FIG. 5.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for stabilizing a paper web in a paper machine, said device comprising:

a continuous unwinding and flying splicing station, the splicing station including a primary paper roll, a secondary paper roll and a cut-off device, said secondary paper roll is adapted to have the paper web unwinding therefrom, said splicing station defining a splicing location, said cut-off device positioned between said secondary paper roll and said splicing location; and a suction trough disposed between said secondary paper roll and said splicing location, said suction trough extending across a width of the paper web, said suction trough including a pair of cylindrical pipes disposed side-by-side and non-rotatably connected to each other, said cylindrical pipes defining a suction zone adjacent the paper web, the paper web is adapted to travel past said suction trough to said splicing location, said suction zone extending substantially across said width of the paper web and being configured to effect a substantially uniform vacuum in a suction zone area, wherein the paper web runs evenly over said suction zone area.

2. The device according to claim 1, wherein said suction trough includes a recess that is open toward the paper web, said recess defining said suction zone.

3. The device according to claim 1, wherein at least one of said pipes includes a plurality of suction perforations, said perforations defining said suction zone.

4. The device according to claim 3, wherein said at least one pipe integrally includes said plurality of suction perforations.

5. The device according to claim 3, wherein said suction trough includes a recess that is open toward the paper web, said recess defining said suction zone, said suction trough further comprising a plate disposed over said recess, said plate including said plurality of suction perforations.

6. The device according to claim 1, wherein said suction trough, viewed in cross section, includes a rounded area of approach.

7. The device according to claim 1, wherein said suction trough, viewed in cross section, includes an approach rounding and an exit rounding.

8. The device according to claim 1, wherein said suction trough includes rounded rims in said suction zone.

9. The device according to claim 1, further comprising a suction system connected to said suction trough and in communication with said suction zone.

10. The device according to claim 9, wherein said suction trough includes a plurality of suction perforations, said perforations defining said suction zone, said perforations gradually increasing in size from a point of connection between said suction trough and said suction system, said perforations effecting a substantially equal vacuum across an entire length of said suction zone.

11. The device according to claim 1, wherein said suction trough includes bounds at each end of said suction zone.

12. The device according to claim 1, further comprising at least one spreader at each end of said suction trough.

13. The device according to claim 12, wherein said spreaders each comprise at least one spreader slot.

14. The device according to claim 12, wherein said spreaders each comprise at least one spreader cam.

15. The device according to claim 12, wherein said spreaders, viewed in a direction of travel of the paper web, slant toward a nearest edge of the paper web.

16. The device according to claim 15, wherein said slant of said spreaders increases from one spreader to an adjacent spreader.

17. A method of performing a flying splice in a paper machine, said method comprising the steps of:

providing a secondary paper roll having a secondary paper web;

providing a primary paper roll having a primary paper web;

providing a splicing roll at a splicing location associated with said primary paper roll;

providing a cut-off device between said secondary paper roll and said splicing location;

providing a suction trough between said secondary paper roll and said splicing location, said suction trough including a pair of cylindrical pipes disposed side-by-side and non-rotatably connected to each other to define a suction zone adjacent the secondary paper web;

rotating and continuously unwinding said secondary paper web from said secondary paper roll at a web travel speed which creates a boundary air layer between said secondary paper web and said suction trough, said secondary paper web traveling past said splicing location;

rotationally accelerating said primary paper roll until a peripheral speed of said primary paper roll is substantially equal to said web travel speed of said secondary paper web;

pulling said secondary paper web against said suction trough by exerting a vacuum upon said secondary paper web with said suction trough;

moving said splicing roll against said secondary paper web and said primary paper roll at said splicing location after said accelerating and pulling steps; and cutting said secondary paper web with said cut-off device.

18. The method of claim 17, comprising the further step of blowing said secondary paper web away from said splicing location.

19. The method of claim 17, wherein said moving step and said cutting step occur substantially simultaneously.

20. The method of claim 19, wherein said pulling step occurs immediately before said moving step and said cutting step.

21. The method of claim 17, wherein said pulling step smoothens out said secondary paper web.

22. The method of claim 17, wherein said cut-off device is disposed between said suction trough and said splicing location.

23. The method of claim 17, comprising the further step of providing a splicing point on a periphery of said primary paper roll, and wherein said moving step is carried out dependent on a position of said splicing point relative to said splicing location.

* * * * *